US007530678B2

(12) United States Patent
Ogura et al.

(10) Patent No.: US 7,530,678 B2
(45) Date of Patent: May 12, 2009

(54) LIQUID CONTAINER AND METHOD FOR MANUFACTURING THE SAME

(75) Inventors: Hideki Ogura, Kawasaki (JP); Ryoichi Matsumoto, Meguro-ku (JP); Shogo Kawamura, Numazu (JP); Ryoji Inoue, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 381 days.

(21) Appl. No.: 11/295,341

(22) Filed: Dec. 6, 2005

(65) Prior Publication Data

US 2006/0119676 A1 Jun. 8, 2006

(30) Foreign Application Priority Data

Dec. 7, 2004 (JP) ..... 2004-354186

(51) Int. Cl.
*B41J 2/175* (2006.01)

(52) U.S. Cl. ..... 347/86

(58) Field of Classification Search ..... 347/85, 347/86, 87

See application file for complete search history.

(56) References Cited

U.S. PATENT DOCUMENTS 5,136,309 A * 8/1992 Iida et al. ..... 347/7
5,400,066 A 3/1995 Matsumoto
5,440,333 A 8/1995 Sykora
6,250,751 B1 * 6/2001 Whitney et al. ..... 347/87
6,540,341 B2 * 4/2003 Hsieh et al. ..... 347/86
6,773,099 B2 * 8/2004 Inoue et al. ..... 347/86

FOREIGN PATENT DOCUMENTS

CN 1548296 A 11/2004
JP 2003-053988 A 2/2003

* cited by examiner

*Primary Examiner*—Anh T. N. Vo

(57) ABSTRACT

A liquid container and its manufacturing method configured to contain a spring member and crimp a flexible member in a frame, wherein positional shift between the flexible member and the fixing member (frame) caused by compression of the spring during manufacturing process is prevented and no device is necessary for spring compression. Accordingly, the liquid container includes a liquid storage portion including a deformable flexible member, a planar portion disposed in the flexible member, and the spring member which abuts on the planar portion to generate negative pressure in the liquid container. The planar portion includes an engaging portion disposed in the planar portion and engaging the elastic portion so as to facilitate holding the elastic portion in a compressed state and releasing the elastic portion from the compressed state.

3 Claims, 7 Drawing Sheets

LIQUID CONTAINER AND METHOD FOR MANUFACTURING THE SAME

BACKGROUND OF THE INVENTION

1. Field of the Invention

The present invention relates to a liquid container applied to an ink jet device, and a method for manufacturing the same.

2. Description of the Related Art

Generally, in a liquid container used for a recording device which forms images or characters on a recording medium by using a recording head to apply a liquid such as ink to the recording medium, a configuration of applying predetermined negative pressure to the liquid in the liquid container has been employed to stably supply the liquid or to prevent leakage thereof.

As one example, there is a configuration which includes an absorbing member in a liquid container and uses a liquid holding force of the absorbing member to apply a negative pressure. Registered U.S. Pat. No. 5,440,333 describes a sealed type ink tank which includes upper and lower flexible members fixed to upper and lower openings of a square frame member. This ink tank contains an arched spring member. The upper and lower flexible members are expanded to the outside being pressed by the spring member to set a liquid container under negative pressure.

In the ink tank of Registered U.S. Pat. No. 5,440,333, the inner arched spring member is formed into a roughly crushed C shape by bending two arched portions. In the case of such a spring, the bent state easily becomes uneven and causes a variation in a manufacturing process. Besides, in the manufacturing process, a step of depositing a flexible film on the frame while compressing the spring may require sizable devices such as a device for compressing the spring and a device for depositing the film while fixing and holding the spring.

In the case of the ink tank having a relatively large capacity described in Registered U.S. Pat. No. 5,440,333, a negative pressure change caused by a slight spring shift or a variation has no influence. However, in the case of an ink tank having a relatively small capacity or size, there is a danger in that stability or functionality will be affected during the manufacturing process. As compared with Registered U.S. Pat. No. 5,440,333, Japanese Patent Application Laid-Open No. 2003-053988 solves the problems as follows:

(1) Adhesion planes of a flexible member and a frame portion are bonded together by forming the flexible member into a convex shape in advance; and (2) Spring members are deformed in parallel by bonding two member components, and compressed while outer surfaces thereof are defined, in order to manufacture a device.

However, even in Japanese Patent Application Laid-Open No. 2003-053988, pressing fixtures for compressing the spring members are necessary. Moreover, when the flexible member is moved in parallel to the frame portion while maintaining planarity of a planar portion of the spring member, position accuracy, and adhesion accuracy are required, which may affect device costs and tact.

SUMMARY OF THE INVENTION

The present invention is directed to a liquid container and a method of manufacturing the same.

The present invention prevents positional shift between a flexible member and a fixing member (frame) caused by spring compression during the manufacturing process in a liquid container configured to include the spring member and crimp the flexible member in the frame.

The present invention provides a simple liquid container and its manufacturing method wherein negative pressure, a capacity and the like are stabilized, no device is necessary for spring compression, and a device is inexpensive.

In one aspect of the present invention, a liquid container for storing a liquid to be supplied to the outside includes a liquid storage portion having a deformable flexible member, a planar portion disposed in the liquid storage portion, an elastic portion which abuts on the planar portion to generate negative pressure in the liquid storage portion, and an engaging portion disposed in the planar portion to engage the elastic portion so as to facilitate holding the elastic portion in a compressed state and releasing the elastic portion from the compressed state.

Another aspect of the present invention is a method for manufacturing a liquid container including an opening to guide a liquid to the outside, a liquid storage portion having a deformable flexible member, a planar portion disposed in the liquid storage portion, and an elastic portion which abuts on the planar portion to generate negative pressure in the liquid storage portion. This method includes a step of engaging and holding the elastic member with the planar portion when the elastic member is in a compressed state, a step of inserting the elastic and planar portions held in the compressed state into the liquid container, a step of fixing the flexible member in the liquid container, and a step of releasing the elastic member from engagement in the compressed state in the liquid container.

According to the present invention, the spring is engaged and held in its compressed state, and the flexible member is welded while this state is maintained during the manufacturing process. Thus, as in the usual case where no springs are used, a device for pressing a spring becomes unnecessary. Moreover, since the flexible member welded to the fixing member (frame) receives no resistance from the spring, and positional shift is hard to occur in the welded portion, it is possible to perform stable manufacturing.

Further features of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate embodiments of the invention and, together with the description, serve to explain the principles of the invention.

FIGS. 2A, 2B-1, 2B-2, 2C, and 2D are diagrams showing a manufacturing process of the liquid container according to the embodiment of the present invention.

FIGS. 3A-1 to 3A-3, 3B-1 to 3B-3, and 3C-1 to 3C-3 are sectional diagrams showing a released state of an engaging portion according to the embodiment of the present invention.

FIGS. 4A-1 and 4A-2, and 4B-1 to 4B-3 are diagrams showing a leaf spring according to a first embodiment of the present invention: FIG. 4A-1 is a perspective diagram of an uncompressed state, FIG. 4A-2 is a perspective diagram of a compressed state, FIG. 4B-1 is an expanded diagram of an engaging portion, FIG. 4B-2 is an expanded diagram of the compressed state, and FIG. 4B-3 is a sectional diagram of the compressed state.

FIGS. 5A-1, 5A-2, and 5B are diagrams showing a leaf spring according to a second embodiment of the present invention: FIG. 5A-1 is a perspective diagram of an uncompressed state, and FIGS. 5A-2 and 5B are perspective diagrams of a compressed state.

FIGS. 6A-1, 6A-2, 6B-1 and 6B-2 are diagrams showing a coil spring according to a third embodiment of the present invention: FIGS. 6A-1 and 6B-1 are perspective diagrams of an uncompressed state, and FIGS. 6A-2 and 6B-2 are diagrams of a compressed state.

FIGS. 7A-1 to 7A-3, FIGS. 7B-1 and 7B-2 are diagrams showing a coil spring according to a fourth embodiment of the present invention: FIGS. 7A-1 and 7B-1 are diagrams of an uncompressed state, and FIGS. 7A-2 and 7B-2 are diagrams of a compressed state.

DETAILED DESCRIPTION OF THE EMBODIMENTS

Embodiments of the invention will be described in detail below with reference to the drawings.

Figure 1A:
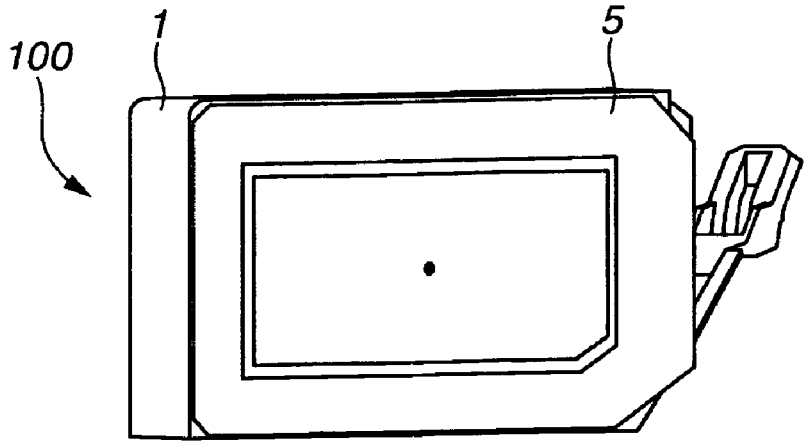
FIG. 1A is an appearance perspective diagram of a liquid container according to an embodiment of the present invention.
Figures 1, 1B:
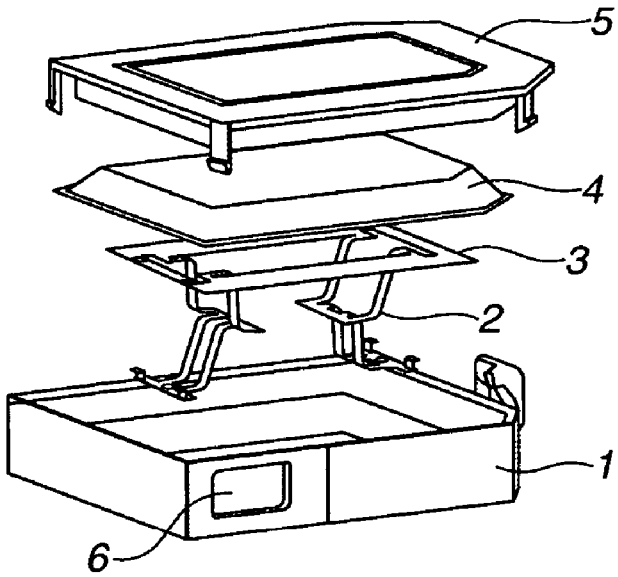
FIGS. 1B-1 and 1B-2 are exploded perspective diagrams showing an internal structure of the liquid container.
Figures 1, 1B, 2:
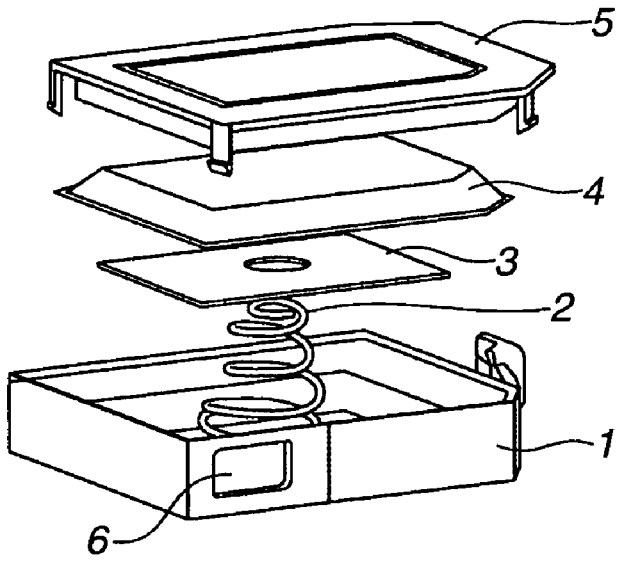

FIGS. 1A, 1B-1 and 1B-2 are perspective diagrams showing a liquid container 100 and its internal structure according to an embodiment of the present invention: FIG. 1A is an appearance perspective diagram of the liquid container 100, and FIGS. 1B-1 and 1B-2 are diagrams showing the internal structure of the liquid container 100. The liquid container 100 according to the embodiment includes a casing member (fixing member) 1, a flexible member 4 which is deformed while a liquid is guided, and a spring member (elastic member) 2 serving as a negative pressure generation mechanism. It further includes a planar member 3 for transmitting pressure generated by the spring member 2 to the flexible member 4, and a cap member 5 for protecting the flexible member 4. The casing member 1 includes a liquid supply port 6 disposed to guide the liquid. To prevent leakage of the liquid stored in the container, the liquid supply port 6 is sealed with a rubber member having a slit, an absorbing member for generating a meniscus force to withstand the negative pressure generated by the spring, a capillary force generation member such as a filter. The embodiment is constituted using a filter (not shown).

Any shape or form can be employed for the spring member 2 as long as it generates a load to meet pressure of the liquid container 100 in its used state. In this case, a leaf spring type (FIG. 1B-1) and a coil spring type (FIG. 1B-2) are shown. Additionally, in the case of the leaf spring type, the planar member can be integrated with the spring member.

Figure 2A:
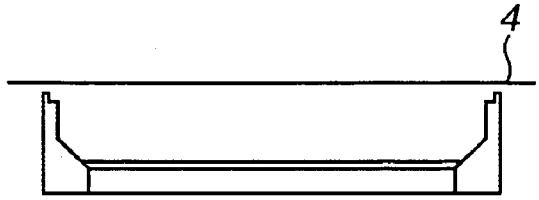
Figures 1, 2B:
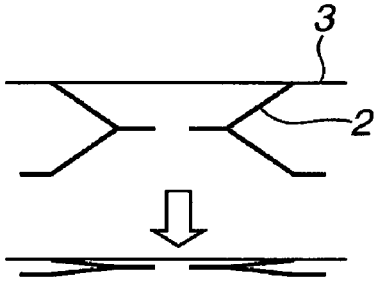
Figures 2, 2B:
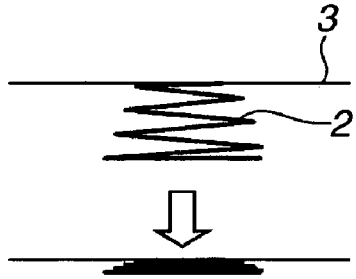
Figure 2C:
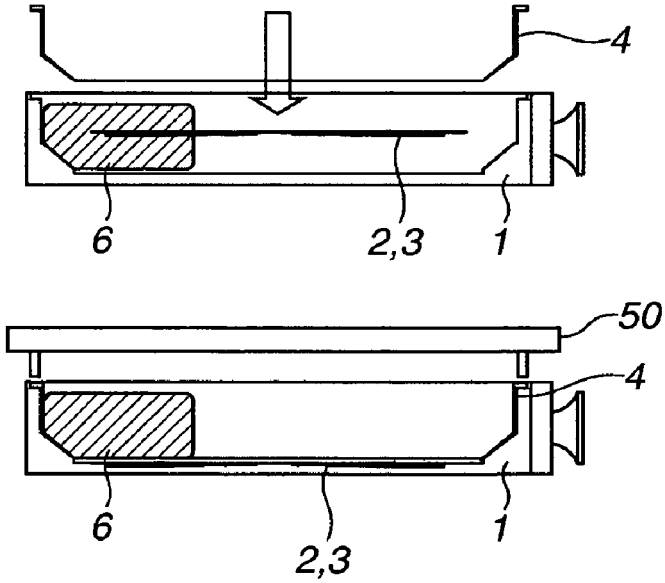
Figure 2D:
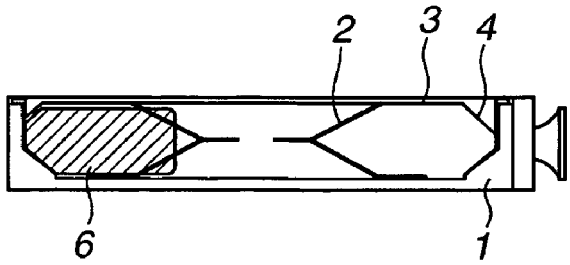

FIGS. 2A, 2B-1, 2B-2, 2C, and 2D show a manufacturing process of the liquid container according to the embodiment of the present invention. The manufacturing process includes the following four steps:

FIG. 2A: a step of forming the flexible member (sheet) 4 into a container shape (convex shape);

FIG. 2B-1 or 2B-2: a step of compressing the planar member 3 and the elongated spring member 2, and engaging them in the compressed state to hold the compressed state;

FIG. 2C: a step of inserting the planar member 3 and the spring member 2 which have been compressed, and the formed flexible member 4 into the casing member 1, and crimping and fixing the flexible member 4 in the liquid container by a welding horn 50; and FIG. 2D: a step of disengaging the spring member 2 and the planar member 3 which have been compressed in FIG. 2B from each other after the cap member 5 is fixed.

The features of the present invention include the step of holding the compressed state of the spring member 2 and the planar member 3 before they are incorporated in the casing member 1 of the liquid container (FIGS. 2B-1 and 2B-2), and the step of crimping the flexible member 4 after the compressed spring and planar members 2 and 3 are incorporated in the liquid container, and releasing the compressed state. Conventionally, in the manufacturing process of a liquid container having a spring therein, a flexible member has been crimped and fixed while the spring in a spread state in a casing member is being compressed. In this case, since the spring is in the spread state as compared with a state when the liquid container is used, the flexible member is easily shifted in position with respect to the casing member, causing instability during the manufacturing process. On the other hand, according to the present invention, the spring member is compressed at least nearly equally or more than equally, compared with the state when the liquid container is used. In that state, the spring member is engaged and incorporated in the liquid container. Subsequently, the engagement is released. Thus, no elastic force of the spring member is applied during the welding of the flexible member.

There are several methods of releasing the engagement of the spring member 2 and the planar member 3 according to the present invention. One method is releasing the engagement by pressing the planar member 3 from the outside of the liquid container to elastically deform the planar member 3. Another method is directly releasing the engagement of the engaging portion by inserting a releasing member into the casing member 1, and various other methods are also known.

Figures 1, 3A:
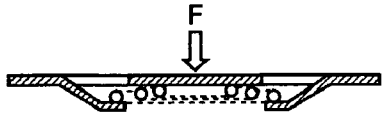
Figures 2, 3A:
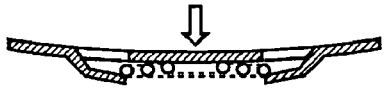
Figures 3, 3A:
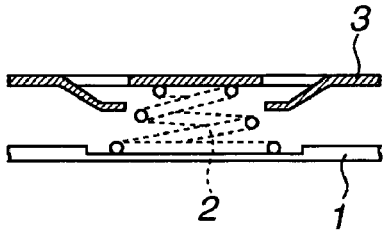
Figures 1, 3B:
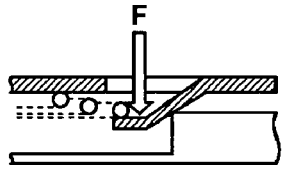
Figures 2, 3B:
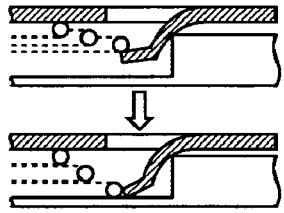
Figures 3, 3B:
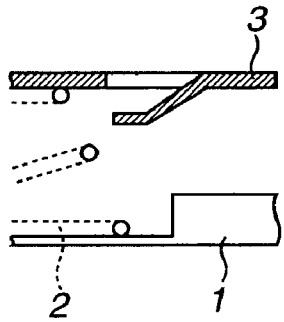
Figures 1, 3C:
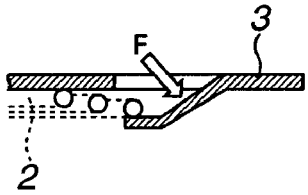
Figures 2, 3C:
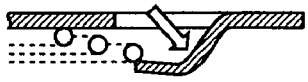
Figures 3, 3C:
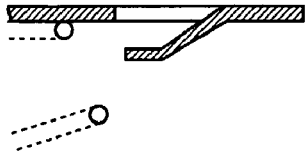

Each of FIGS. 3A-1 to 3A-3, 3B-1 to 3B-3, and 3C-1 to 3C-3 shows an example of a manner of elastic deformation near the engaging portion when the engaging portion is released. Referring to FIGS. 3A-1 to 3A-3, for example, the engaging portion is released by directly applying an external force F to a center of the planar member 3 to deform its entire surface. Referring to FIGS. 3B-1 to 3B-3 and FIGS. 3C-1 to 3C-3, the engaging portion is released by directly applying the external force F to the engaging portion to elastically deform the same. Thus, after the welding of the flexible member 4 and the fixing of the cap member 5, fixtures are inserted through the opening of the cap member 5 to press the engaging portion, and the engaging portion is released using its elastic deformation, and thereby the liquid container is completed.

According to the embodiment, the flexible member 4 is fixed to the liquid container, the cap member 5 is fixed to the liquid container, and the ink is then injected. However, the present invention is not limited to this embodiment. A liquid container having a flexible member 4 fixed therein may be prepared while a spring member 2 is held in a compressed state, and ink may be injected after the compressed state of the spring member 2 is released. In other words, it is important that the spring member 2 is held in the compressed state to prevent interference of an elastic force of the spring member 2 when the flexible member 4 and the liquid container are fixed.

Next, embodiments of shapes and configurations to hold various spring types in the compressed state according to the present invention will be described.

Each of FIGS. 4A-1 and 4A-2, and 4B-1 to 4B-3 shows a leaf spring according to a first embodiment. The first embodiment is directed to a type of a leaf spring where a planar member 3 and a spring member 2 are integrated.

Figures 1, 4A:
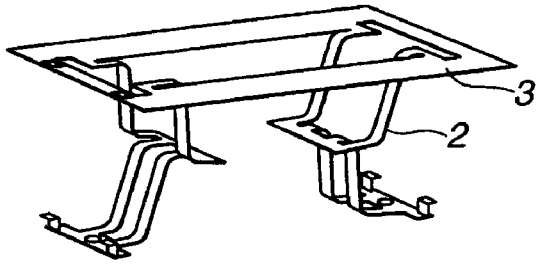
Figures 2, 4A:
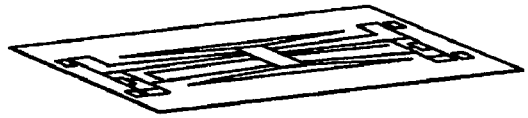
Figures 1, 4B:
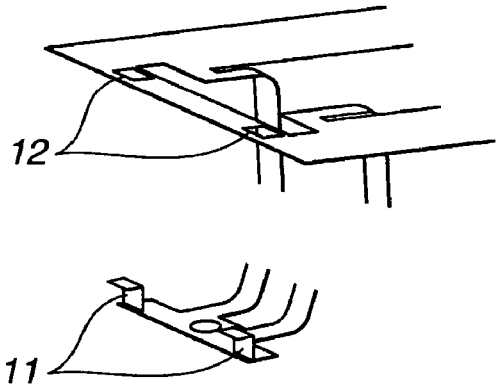
Figures 2, 4B:
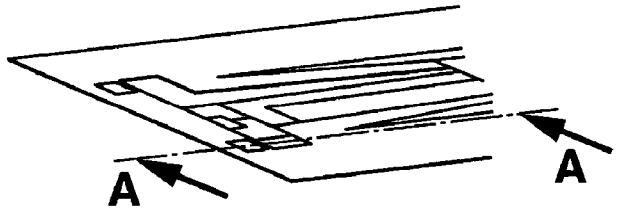
Figures 3, 4B:
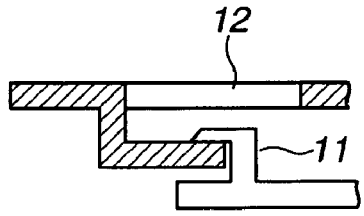

FIG. 4A-1 shows a leaf spring in an uncompressed state, and FIG. 4A-2 shows a leaf spring engaged and held in a compressed state. The leaf spring of the first embodiment has a shape which includes two leaf springs in a side face since a flexible member 4 is displaced in parallel at the time of guiding a liquid. FIG. 4B-1 is an expanded diagram showing an engaging portion that holds the spring in the compressed state. In FIG. 4B-1, reference numeral 11 denotes two hook-shaped projections for engagement. The hook-shaped projections 11 are engaged with two openings 12 of FIG. 4B-1. As shown in FIG. 4A-1, these shapes are disposed on both sides of the leaf spring. During compression, the openings 2 and the engaging projections 11 are engaged with each other to hold a compressed state. FIG. 4B-2 is an expanded diagram of an engaged state, and FIG. 4B-3 is a sectional diagram cut along the line A-A in FIG. 4B-2 of the engaging portion. Thus, the number of components can be reduced by integrating the planar member 3 and the spring member 2, position accuracy can be improved, and its handling can be facilitated.

Figures 1, 5A:
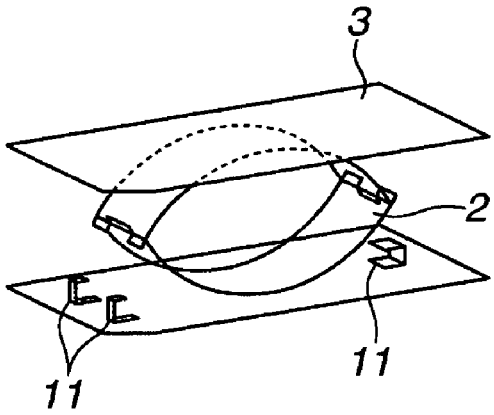
Figures 2, 5A:
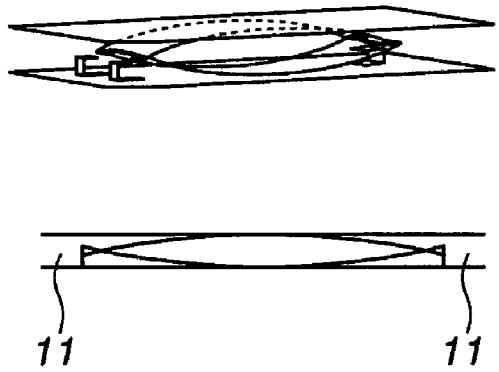
Figure 5B:
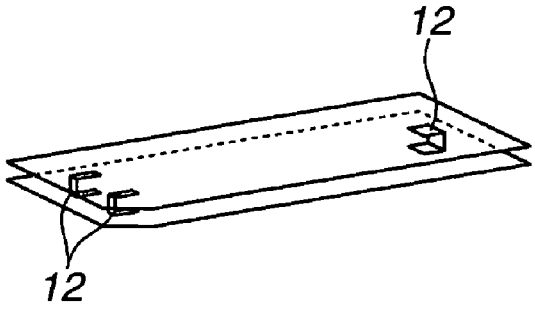

Each of FIGS. 5A-1, 5A-2, and 5B shows a leaf spring according to a second embodiment of the present invention. The second embodiment is directed to a leaf spring where a planar member 3 and a spring member 2 are separate. FIG. 5A-1 shows a leaf spring in the uncompressed state, and FIG. 5A-2 shows a leaf spring engaged and held in the compressed state. According to the second embodiment, an engaging projection 11 is disposed in the planar member 3, and an end of the spring member 2 is engaged with the engaging projection 11 to hold the compressed state. FIG. 5B shows a state where the planar members 3 are engaged with each other. In this case, an opening 12 for engagement is disposed on the planar member 3 side which has no engaging projection 11. The opening 12 is engaged with the engaging projection 11 to engage and hold the spring in its compressed state.

Figures 1, 6A:
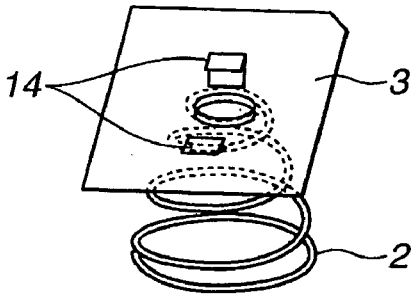
Figures 2, 6A:
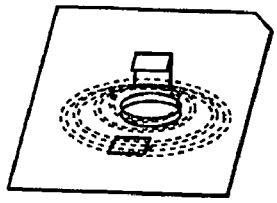
Figures 1, 6B:
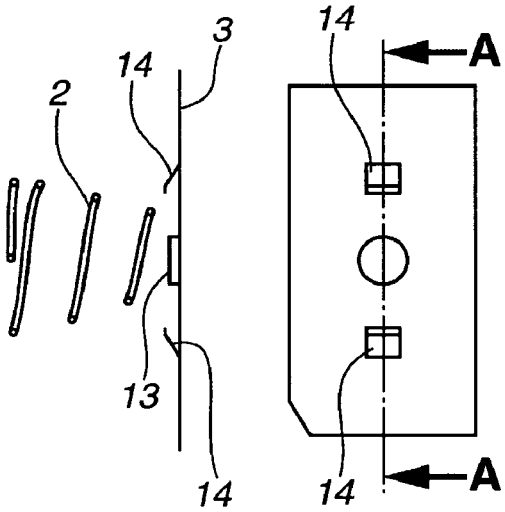
Figures 2, 6B:
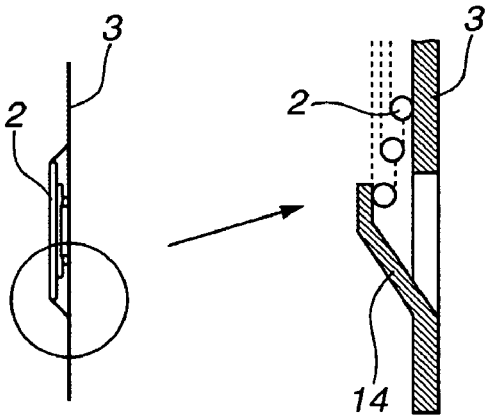

FIGS. 6A-1 and 6A-2, and 6B-1 and 6B-2 show a third embodiment which uses a coil spring as an elastic member. According to the present invention, all types of springs such as a compressed coil spring and a tensile coil spring can be used. From the standpoint of efficiency in use of a liquid container, however, conical coil springs can be used because it is hard to overlap the springs when compressed. The third embodiment will be described which uses a conical coil spring type. FIG. 6A-1 is a perspective diagram of a planar member 3 and a conical coil spring 2 in an uncompressed state, and FIG. 6A-2 is a perspective diagram of a planar diagram 3 and a conical coil spring 2 engaged and held in a compressed state. The planar member 3 includes a rib 13 formed in a center to prevent shift of the coil spring 2, and engaging portions 4 formed in two left and right places thereof to engage the coil spring 2. During compression, a bottom surface portion of the coil spring 2 itself is engaged with the engaging portions 14 to hold a compressed state (refer to FIGS. 6B-1 and 6B-2). The embodiment provides an ink tank that is efficient in use of ink.

Figures 1, 7A:
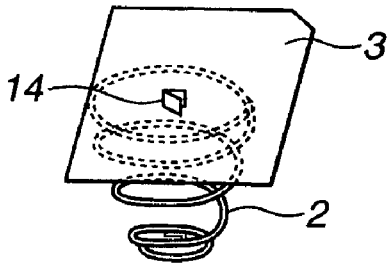
Figures 2, 7A:
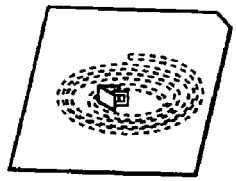
Figures 3, 7A:
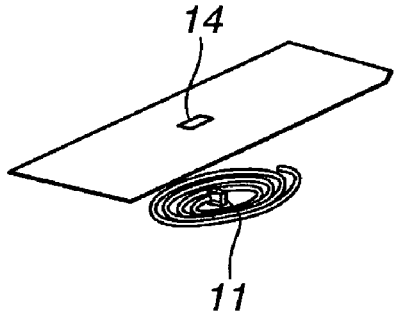

Each of FIGS. 7A-1 to 7A-3, and 7B-1 and 7B-2 shows a coil spring according to a fourth embodiment of the present invention. The fourth embodiment is directed to a type where a spring member 2 is a coil spring, and a shape of a tail end of the coil spring is an engaging projection 11. FIG. 7A-1 is a perspective diagram of a planar member 3 and a conical coil spring 2 in an uncompressed state, and FIG. 7A-2 is a perspective diagram of a planar member 3 and a conical coil spring 2 engaged and held in a compressed state.

Figures 1, 7B:
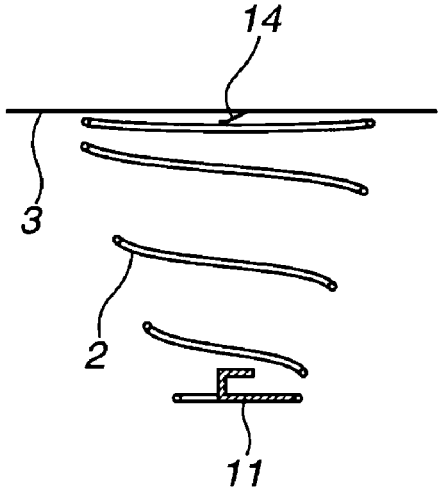
Figures 2, 7B:
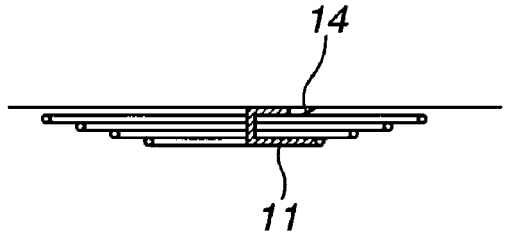

The coil spring of the fourth embodiment includes an engaging projection 11 similar to that shown in FIG. 7A-3 on a side of small diameter. The projection 11 is engaged with an engaging portion 14 disposed in the planar member 3 when the coil spring is compressed. In order to enable stable fixing in one place, the coil spring is compressed in a coil center. Therefore, according to the fourth embodiment, the engaging projection 11 is disposed in a coil on a small radius side and engaged there. FIG. 7B-1 is a sectional diagram of an uncompressed state, and FIG. 7B-2 is a sectional diagram of a compressed state.

As described above, according to the present invention, any type and shape of springs can be used as long as engaging portions are disposed in the springs or the planar members to hold a compressed state. The present invention is not limited to the liquid containers of the embodiments. The invention can be applied to an ink jet cartridge where a recording head for discharging ink and a liquid container are integrated.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims priority from Japanese Patent Application No. 2004-354186 filed Dec. 7, 2004, which is hereby incorporated by reference herein in its entirety.

What is claimed is:

1. A liquid container for supplying a liquid to an ink jet head, comprising the liquid container:

a liquid storage portion configured to store the liquid;

a deformable flexible member constructing a part of the liquid storage portion;

a planar member disposed inward the liquid storage portion and in contact with the flexible member; and an elastic member, a part of the elastic member being fixed to the planar member, biasing the liquid storage portion in an expanding direction so as to have the inside of the liquid storage portion be in a negative pressure state, wherein the planar member includes a hook at a part of the planar member, the hook enabling the elastic member to be in a compressed and deformed state by engaging with a part of the elastic member.

2. A method for manufacturing a liquid container including a liquid storage portion configured to store a liquid, a deformable flexible member constructing a part of the liquid storage portion, a planar member disposed inward the liquid storage portion and in contact with the flexible member; and an elastic member, a part of the elastic member being fixed to the planar member, biasing the liquid storage portion in an expanding direction so as to have the inside of the liquid storage portion be in a negative pressure state, the planar member having an engaging portion configured to maintain the elastic member in a compressed and deformed state, and having a hook at a part of the planar member, the method comprising:

preparing a structural member, the elastic member of the structural member being in a compressed and deformed state, by engagement of the hook and a part of the elastic member;

disposing the prepared structural member of the planar member and the elastic member in the liquid container;

fixing the flexible member to the liquid container in a state where the pair consisting of the planar member and the elastic member is covered by the flexible member; and releasing the compressed state of the elastic member by unhooking.

3. A method according to claim 2, further comprising injecting ink into the liquid storage portion after releasing the compressed state of the elastic member by unhooking.

* * * * *